US012439961B2

(12) United States Patent
Asterhed

(10) Patent No.: US 12,439,961 B2
(45) Date of Patent: Oct. 14, 2025

(54) SNUS CONTAINER, A METHOD OF MANUFACTURING A SNUS CONTAINER AND A MOULD

(71) Applicant: SÄVJO PLASTIC AB, Sävsjö (SE)

(72) Inventor: Tommy Asterhed, Sävsjö (SE)

(73) Assignee: SÄVJO PLASTIC AB, Sävsjö (SE)

( * ) Notice: Subject to any disclaimer, the term of this patent is extended or adjusted under 35 U.S.C. 154(b) by 12 days.

(21) Appl. No.: 18/569,848

(22) PCT Filed: Apr. 7, 2022

(86) PCT No.: PCT/EP2022/059255

§ 371 (c)(1),
(2) Date: Dec. 13, 2023

(87) PCT Pub. No.: WO2022/263038

PCT Pub. Date: Dec. 22, 2022

(65) Prior Publication Data

US 2024/0277045 A1 Aug. 22, 2024

(30) Foreign Application Priority Data

Jun. 14, 2021 (SE) ..... 2150763-7

(51) Int. Cl.
*A24F 23/00* (2006.01)
*A24F 23/02* (2006.01)

(52) U.S. Cl.
CPC ..... *A24F 23/02* (2013.01)

(58) Field of Classification Search
CPC ..... A24F 23/02; A24F 23/00
(Continued)

(56) References Cited

U.S. PATENT DOCUMENTS 4,607,768 A 8/1986 Taber et al.
6,158,632 A * 12/2000 Ekkert ..... B65D 47/089 220/254.3
(Continued)

FOREIGN PATENT DOCUMENTS

CA 2223335 A1 6/1999
CA 2252215 A1 5/2000
(Continued)

OTHER PUBLICATIONS

Swedish Office Action and Search Report for Swedish Application No. 2150763-7, mailed Oct. 27, 2021, (8 pages).
(Continued)

*Primary Examiner* — Steven A. Reynolds
(74) *Attorney, Agent, or Firm* — Kagan Binder, PLLC

(57) ABSTRACT

The present disclosure relates to a snus container (1), comprising: a body (11) defining a first compartment (110); a first lid (12) adapted to be releasably attached to the body (11) so that it closes the first compartment (110), the first lid (12) defining a second compartment (120) separated from the first compartment (110), and a second lid (13) pivotably coupled to the first lid (12) to be able to, upon pressing an actuation region (131) of the second lid (13), to pivot about a pivot axis (P) from a closed position, in which the second lid (13) closes the second compartment (120), to a semi-open position, wherein the second lid (13) is pivotably coupled to the first lid (12) by means of a snap-in coupling (122, 132) enabling the second lid (13) to reversibly detach from the first lid (12) when the second lid (13) is in the semi-open position. A method (S0) of manufacturing said snus container (1) and a mould (100) to be used in said method (S0) is also disclosed.

14 Claims, 6 Drawing Sheets

(58) Field of Classification Search
USPC ..... 206/260, 242
See application file for complete search history.

(56) References Cited

U.S. PATENT DOCUMENTS

| | | | | |
|---|---|---|---|---|
| D640,546 | S * | 6/2011 | Berggren | D9/428 |
| 8,579,152 | B2 * | 11/2013 | Cronin | B65D 43/0212 220/826 |
| 8,869,980 | B2 * | 10/2014 | Berggren | B65D 51/28 206/256 |
| 8,887,938 | B2 * | 11/2014 | Goldman | B65D 77/30 220/4.23 |
| 9,538,785 | B2 * | 1/2017 | Loos | B65D 51/28 |
| 10,463,075 | B2 * | 11/2019 | Beardsall | A24F 23/00 |
| 2007/0175909 | A1 * | 8/2007 | Solowiejko | B65D 43/169 220/826 |
| 2009/0014450 | A1 * | 1/2009 | Bjorkholm | A24F 23/04 220/521 |
| 2012/0168329 | A1 * | 7/2012 | Berggren | B65D 51/28 206/256 |
| 2021/0061526 | A1 * | 3/2021 | Wisniewski | B65D 47/0809 |

FOREIGN PATENT DOCUMENTS

| | | | |
|---|---|---|---|
| EP | 2236433 | A1 | 10/2010 |
| EP | 2767484 | A1 | 8/2014 |
| RU | 2678684 | C1 | 1/2019 |
| WO | 2014/124939 | A1 | 8/2014 |
| WO | 2016202594 | A1 | 12/2016 |

OTHER PUBLICATIONS

International Search Report and Search Report for International Application No. PCT/EP2022/059255, mailed Aug. 22, 2022, (12 pages).

Decision of Grant, and machine translation, from counterpart Russian Application No. 2023131143/03, dated Mar. 17, 2025, 22 pp.

* cited by examiner

SNUS CONTAINER, A METHOD OF MANUFACTURING A SNUS CONTAINER AND A MOULD

CROSS-REFERENCE TO RELATED APPLICATIONS

This application claims priority to International Application No. PCT/EP2022/059255, filed Apr. 7, 2022 and titled "A SNUS CONTAINER, A METHOD OF MANUFACTURING A SNUS CONTAINER AND A MOULD," which in turn claims priority from a Swedish Patent Application having serial number 2150763-7, filed Jun. 14, 2021, all of which are incorporated herein by reference in their entireties.

TECHNICAL FIELD

The present inventive concept relates to a snus container comprising a plurality of compartments for storing packaged snus portions and a method of manufacturing a snus container.

BACKGROUND

Snus is generally sold to consumers as packaged snus portions stored in a container with a resealable lid. These containers are conventionally cylindrical in shape and made of a plastic or polymer material.

After a snus portion is used, the snus portion is to be discarded, for example in a public waste bin. However, when there is no waste bin in the vicinity, there is a need to store used snus portions. A solution to this problem is to provide snus containers comprising two separate compartments. By this, unused snus portions can be stored in one compartment and used snus portions can be stored in a separate compartment. This allows used snus portions to be temporarily stored until they can be discarded in a waste bin. Such a two-compartment snus container is disclosed in e.g. EP 3503748 A1 or EP 2308769 A1.

A problem of two-compartment snus containers is the added complexity which adds cost and complicates manufacturing and/or assembly. Snus containers of greater complexity may be more frail and thus more likely to break. Such snus containers may also be less intuitive to use. Each of these aspects may result in a frustrating user experience. Furthermore, it is difficult to provide a two-compartment snus container wherein the second compartment for storing used snus portions is Sufficiently large and does not significantly limit the space of the first compartment. It is therefore of interest to provide a two-compartment snus container of simpler and more efficient design that is cheap to produce.

SUMMARY

It is an object of the present invention to provide an improved solution that alleviates the mentioned drawbacks with present solutions. In particular, a first object is to provide a snus container that provides a simple and space-efficient design with respect to the two compartments. This object is solved by the invention as defined in claim 1. A second object is to provide a snus container that is cheap to produce and easy to assemble. This object is solved by the invention as defined in claim 1. A third object is to provide a method of manufacturing such a snus container of simple and space-efficient design. This object is solved by the invention as defined in claim 9. A fourth object is to provide a mould for use in said method. This object is solved by the invention as defined in claim 10.

According to a first aspect of the invention, a snus container is provided. The snus container comprises: a body defining a first compartment; a first lid adapted to be releasably attached to the body so that it closes the first compartment, the first lid defining a second compartment separated from the first compartment, and a second lid pivotably coupled to the first lid to be able to, upon pressing an actuation region of the second lid, to pivot about a pivot axis from a closed position, in which the second lid closes the second compartment, to a semi-open position, wherein the second lid is pivotably coupled to the first lid by means of a snap-in coupling enabling the second lid to reversibly detach from the first lid when the second lid is in the semi-open position.

By this snus container, a snus container with a first compartment for storing unused snus portions and a second compartment for storing used snus portions is provided. Moreover, by this snus container, the second lid may still cover the opening of the second compartment until it has been intentionally pulled away from the first lid. This is an advantageous design as it may prevent the second compartment of the snus container to be accidentally opened when carried in a pocket or a bag. This is an advantageous design also as it allows for the space to be more efficiently used. This is due to the second lid being adapted to be initially pressed into the second compartment before it is removable from the first lid so that the second compartment may be accessed. Thus, the second compartment may have a wider bottom surface while having a thinner depth which consequently allows for a larger first compartment as well. In some conventional solutions, see e.g. EP 2308769 A1, the first lid defines a space for a portion of the lid to move in when opened, which space cannot be used to store unused or used snus portions. Thereby, the present snus container solves the first object above.

Moreover, the components of the snus container, i.e. the body, the first lid and the second lid are all relatively simple in design and may be manufactured by e.g. injection moulding using cheap material such as a plastic or a polymer material. After manufacturing the components, the snus container is also easy to assemble. Thereby, the present snus container solves the second object above also.

By "releasably attached", it may mean that a component A is adapted to be attached to, and reversibly detached to, a component B.

By "reversibly detached", it may mean that a component A is adapted to be detached from, and re-attached to, a component B a number of times.

By "actuation region", it may mean a region and/or a surface adapted in size and shape for facilitated interaction to actuate a movement of the second lid.

By "open position", it may mean a position wherein access to a compartment is allowed.

By "closed position", it may mean a position wherein access to a compartment is prevented.

By "semi-open position", it may mean a position wherein access to a compartment is prevented yet a position wherein the second lid is removable. It may mean a position wherein a gap between the first lid and the second lid is provided which allows for insertion of snus portions into the second compartment but does not allow access to the snus portions unless the snus container is oriented in a specific orientation.

By "snap-in coupling", it may mean a coupling adapted in shape and size enabling a first component A to be pivotably and releasably attached to a second component B in a manner allowing some predetermined pivoting motion. It may further mean that the first component A is maintained in said position relative the second component B by means of a flexible portion provided by either first and/or second component B which may flex upon being subjected to a predetermined force, thereby allowing the first component A to be released.

The snus container may be adapted in size and shape to have a form factor similar to conventional snus containers. The snus container may have a substantially cylindrical shape. The first compartment may have a substantially cylindrical shape also. The second compartment may have a substantial cylindrical shape. One of the first compartment and the second compartment may be larger than the other. The larger compartment may be intended for storing unused snus portions while the smaller compartment is intended for temporarily storing used snus portions. The first compartment may be larger than the second compartment. The second compartment may be larger than the first compartment. Alternatively, the first compartment and the second compartment have substantially the same size. In case of cylindrical geometry, the first compartment may have a larger diameter than the second compartment or vice versa. The first compartment may have a height larger than the second compartment as measured from a center of the bottom of each compartment in a vertical direction to the respective lid covering said compartment or vice versa. The height ratio of the height of the first compartment to the height of the second compartment may be about 1.0-1.5, 1.5-2.0, 2.0-2.5, 2.5-3.0, 3.0-3.5, 3.5-4.0, or alternatively about 0.2-0.4, 0.4-0.6, 0.6-0.8, 0.8-1 if the first compartment has a shorter height than the second compartment.

Moreover, the first lid may have a cylindrical body adapted to be at least partially inserted into the first compartment. The cylindrical body of the first lid may define the second compartment. The second compartment may have a cylindrical shape. The first compartment may have a cylindrical shape.

The snus container may be made from a polymer material. The snus container may be made from a plastic material. Alternatively, the snus container may be made from a material comprising a metal such as aluminum, titanium, etc. In a preferred embodiment, the body, first lid and the second lid are all made from the same material.

The actuation region may be provided by a predefined actuation surface on the outer side of the second lid. The predefined actuation surface may have a circular shape. The predefined actuation surface may have a diameter of 1-2 cm. The predefined actuation surface may be recessed relative the surrounding surface of the outer side of the second lid. The predefined actuation surface may be smoothly recessed, i.e. having a slight curvature. The predefined actuation surface may be adapted with a texture facilitating identification of where to press the second lid to cause it to pivot to the semi-open position. By this, a more satisfactory user experience may be achieved.

A further advantage of this invention is that the first lid does not need to define any recesses to enable access to the second lid in order to open the second compartment. Instead, the second compartment is openable by merely pressing the actuation region so that the second lid is pivoted to the semi-open position at which position the second lid is accessible to be gripped and detached from the first lid to allow access into the second compartment. This allows for a more durable and cost-effective design.

According to one embodiment, the second lid comprises a first portion adapted to move away from the bottom of the second compartment when the second lid pivots to the semi-open position, thereby exposing a gripping region of the second lid, and a second portion connected to the first portion and providing the actuation region so that when pushed toward the bottom of the second compartment, the second lid is actuated to pivot from the closed position to the semi-open position. The gripping region may facilitate gripping of the second lid, thereby making it easier to remove the second lid from the first lid to access the second compartment. The gripping region may be provided by a gripping edge. The second lid may be adapted in shape and size to define a recess adjacent to the gripping edge. When the second lid is in the semi-open position, the gripping edge may be positioned so that it can be gripped.

According to one embodiment, the second lid is adapted to be maintained in the closed position by means of at least one latching protrusion adapted to latch with a respective latching recess until a predetermined force acts on the actuation region causing the second lid to pivot away from the closed position toward the semi-open position. By this, the second lid may be maintained in a closed position. Said at least one latching protrusion may be provided by the second lid while the respective latching recess is provided by the first lid, or vice versa. The at least one latching protrusion and the respective latching recess may be arranged accordingly so that the latching protrusion latches with the respective latching recess when the second lid is in the closed position.

When a latching protrusion is provided by the second lid, it may extend out from a side surface of the second lid adapted to face an inner side wall of the second compartment defined by the first lid. In such a case, the respective latching recess may be provided along said inner side wall of the second compartment defined by the first lid.

When a latching protrusion is provided by the first lid, it may extend out from an inner side wall of the second compartment defined by the first lid adapted to face a side surface of the second lid. In such a case, the respective latching recess may be provided along said side surface of the second lid.

The snus container may comprise a plurality of latching protrusions and respective latching recesses adapted to work together to maintain the second lid in the closed position. The snus container may comprise one or more latching protrusions provided by the second lid adapted to latch with respective latching recess provided by the first lid. The snus container may additionally or alternatively comprise one or more latching protrusions provided by the first lid adapted to latch with respective latching recesses provided by the second lid.

The at least one latching protrusion may be adapted in size and shape to define a curved outer face. This may facilitate said latching protrusion to latch with, and unlatch from, said respective latching recess. Similarly, said respective latching recess may be adapted in size and shape to define a curved recess. This may facilitate said respective latching recess to allow said at least one latching protrusion to be moved in and out of the respective latching recess.

The snus container may comprise 1-2, 2-3, 3-4, 4-5, 5-6, 6-7, 7-8, 8-9, 10 or more latching protrusions adapted to engage with a respective latching recess.

According to one embodiment, the second lid comprises at least two latching protrusions, preferably four latching protrusions, wherein each of the first portion and the second portion of the second lid comprises at least one respective latching protrusion of said at least two latching protrusion. By this, the second lid is more securely maintained in the closed position. The at least two latching protrusions or preferably four latching protrusions, and the respective latching recesses, may be symmetrically arranged between the second lid and the first lid. By this, the second lid may be even more securely maintained in the closed position.

According to one embodiment, the snap-in coupling is provided by means of two pivot protrusions mutually arranged to define the pivot axis and adapted to releasably couple to respective pivot recesses to enable the second lid to pivot about the pivot axis. By this, the second lid may easily attach and detach to the first lid as necessary to and from a position where the second lid is pivotably attached to the first lid. The two pivot protrusions may be arranged to the second lid and the respective pivot recesses may be consequently arranged to the first lid, or vice versa.

When arranged to the second lid, the two pivot protrusions may extend out from side surfaces of the second lid adapted to face inner side walls of the second compartment defined by the first lid. In such a case, the respective pivot recesses may be arranged accordingly to said inner side walls of the second compartment defined by the first lid.

When arranged to the first lid, the two pivot protrusions may extend out from inner side walls of the second compartment defined by the first lid adapted to face side surfaces of the second lid. In such a case, the respective pivot recesses may be arranged accordingly to said side surfaces of the second lid.

The two pivot protrusions and the respective pivot recesses may be arranged such that the pivot axis is parallel to a center line running from two opposite points of the second lid.

According to one embodiment, the second lid comprises an engaging portion adapted in size and shape to engage with the bottom of the second compartment when the second lid is in the semi-open position. By this, the second lid may be prevented from being pushed too far into the second compartment, i.e. a minimum height of the second compartment is ensured. Moreover, by this, it provides a support that facilitates detaching the second lid from the first lid when in the semi-open position.

The engaging portion may extend out from a bottom of the second lid. The engaging portion may extend partly in a circumferential direction of the second lid. The "height" of the extension out from the bottom of the second lid may vary at a location proximate the actuation region such that a large contact area is established between the engaging portion and the bottom of the second compartment. By height, it may mean the distance measured from the bottom of the second lid in a perpendicular direction to the furthermost part of the engaging portion. The engaging portion may have a minimum height at a position perpendicular from the pivot axis along said circumferential direction. The height of the engaging portion may increase in each of the two circumferential directions toward points proximate the pivot axis. The engaging portion may be a portion of an otherwise cylindrical inner side wall adapted to be received in the second compartment. The engaging portion may define a first half of the cylindrical inner side wall, whereas the other half of the cylindrical inner side wall has a constant height adapted in shape and size so that it prevents the second lid to be pushed so that the half of the second lid not providing the actuation region is pushed into the second compartment.

According to one embodiment, the first lid comprises a boundary element extending up from the bottom of the second compartment at a position proximate the actuation region. By this, snus portions may be prevented from being positioned in the second compartment such that it limits the second lids ability to pivot about the pivot axis. The boundary element may extend up from the bottom of the second compartment at a position proximate the actuation region to a point where it at most abuts the second lid when in a semi-open position. The boundary element may be a part of a cylindrical inner side wall extending up from the bottom of the second compartment. Thus, the inner side wall may define a region where snus portions may reside. Moreover, the boundary element may act as a pivot element when detaching the second lid from the first lid.

According to one embodiment, the snus container is adapted in shape and size so that the pivot angle $\alpha$ of the second lid when pivoted between the closed position and the semi-open position is 5-20 degrees, preferably 5-15 degrees, and most preferably 6-10 degrees.

According to a second aspect of the invention, a method of manufacturing the snus container according to the first aspect or any embodiments thereof is provided. The method comprises the steps of: providing a mould defining a plurality of mould cavities corresponding to the shapes of the body, the first lid, and the second lid of the snus container; injecting a material into the plurality of mould cavities, and once solidified, ejecting the snus container from the mould. By this, a snus container of simple and space-efficient design may be provided, thereby solving the third object of the invention.

The material may be injected into the plurality of mold cavities by means of one or more nozzles adapted to guide material into said mould cavities. The material may be injected by means of an injection device. The material may be heated to a melting temperature so as it becomes a fluid. When cooled, the material then solidifies in said cavities. The snus container may be preferably made from a plastic or a polymer material. Alternatively, the snus container may be made from a material comprising a metal such as aluminum, titanium, etc. The snus container may be formed as a single continuous part, which is after assembly separated into the different parts, i.e. the body, the first lid and the second lid. The body, the first lid and the second lid are all made from the same material.

According to a third aspect of the invention, a mould is provided. The mould is adapted in shape and size to define a plurality of cavities corresponding to the shapes of the body, first lid and second lid of the snus container according to the first aspect or any embodiments thereof. By this, the fourth object of the invention is solved. The mould may be adapted to be used in the method of the second aspect.

The mould may comprise a first mould part and a second mould part. The first part may be an upper part while the second part may be a lower part, or vice versa. The first and second mould part may be adapted to be pressed together to form said mould cavities corresponding to the shape of the snus container. The first part may be adapted in shape and size to define a plurality of recesses adapted to receive protrusions respectively of the second part when the first and second part are pressed together. The recesses and protrusions may together define mould cavities corresponding to the body, first lid, and second lid of the snus container. The first and/or second part may further define passageways interconnecting the recesses for allowing material to flow between the respective mould cavities. The mould may be adapted to connect with a nozzle for guiding material into the mould cavities. The mould may further be adapted with one or more injector pins for ejecting the snus container once solidified.

The invention is defined by the appended independent claims, with embodiments being set forth in the appended dependent claims, in the following description and in the drawings.

BRIEF DESCRIPTION OF THE DRAWINGS

The invention will in the following be described in more detail with reference to the enclosed drawings, wherein.

DESCRIPTION OF EMBODIMENTS

Figure 1:
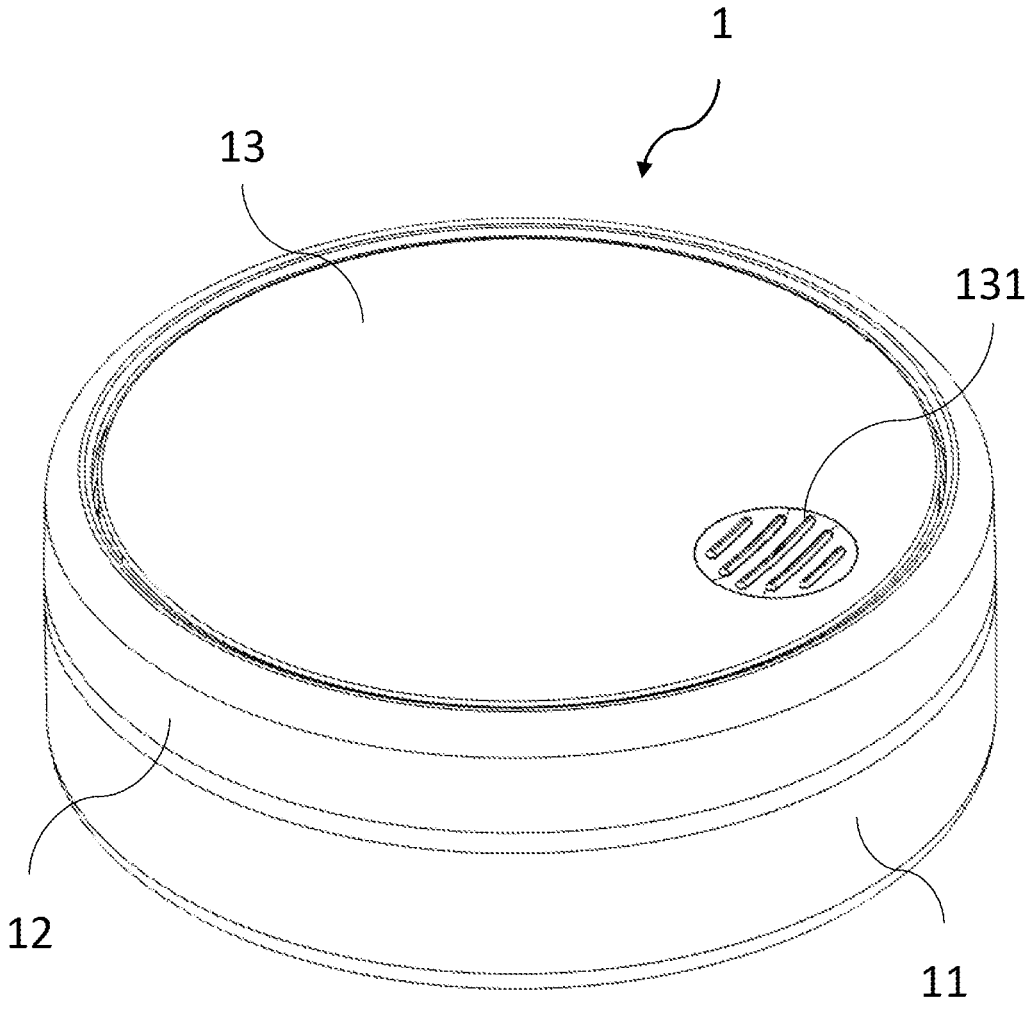
FIG. 1 shows a perspective view of the snus container according to one embodiment of the invention.

The present invention will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements.

FIG. 1 shows a perspective view of a snus container 1 according to one embodiment of the invention. The snus container 1 comprises a body 11 defining a first compartment 110. The snus container 1 further comprises a first lid 12. The first lid 12 is adapted to be releasably attached to the body 11 so that it closes the first compartment 110. In FIG. 1, the first lid 12 is in the closed position in which the first lid 12 closes the first compartment 110. The first lid 12 also defines a second compartment 120 separated from the first compartment 110. The snus container 1 further comprises a second lid 13 pivotably coupled to the first lid 12 to be able to, upon pressing an actuation region 131 of the second lid 12, to pivot about a pivot axis P from a closed position, in which the second lid 13 closes the second compartment 120, to a semi-open position. The pivot axis P is shown in e.g. FIG. 3. The snus container 1 is shown with the second lid 13 being in the semi-open position in e.g. FIG. 4. In FIG. 1, the second lid 13 is in the closed position, thereby closing the second compartment 120. Moreover, the second lid 13 is pivotably coupled to the first lid 12 by means of a snap-in coupling 122, 132 enabling the second lid to reversibly detach from the first lid 12 when the second lid 13 is in the semi-open position. Thus, by means of the snap-in coupling 122, 132, the second lid 13 may be detached from the first lid 12 in order to fully open the second compartment 120.

As further shown in FIG. 1, the snus container 1 is substantially cylindrical in shape similar to the conventional design of current snus containers. Both the first lid 12 and the second lid 13 is adapted with a circular shape. Moreover, the tope edge and bottom edge of the snus container are slightly curved. Such a design without any sharp edges makes it more comfortable to hold and carry around in a pocket of clothing. The snus container 1 is however not limited to such design and may be provided in alternative shapes as necessary.

Figure 2:
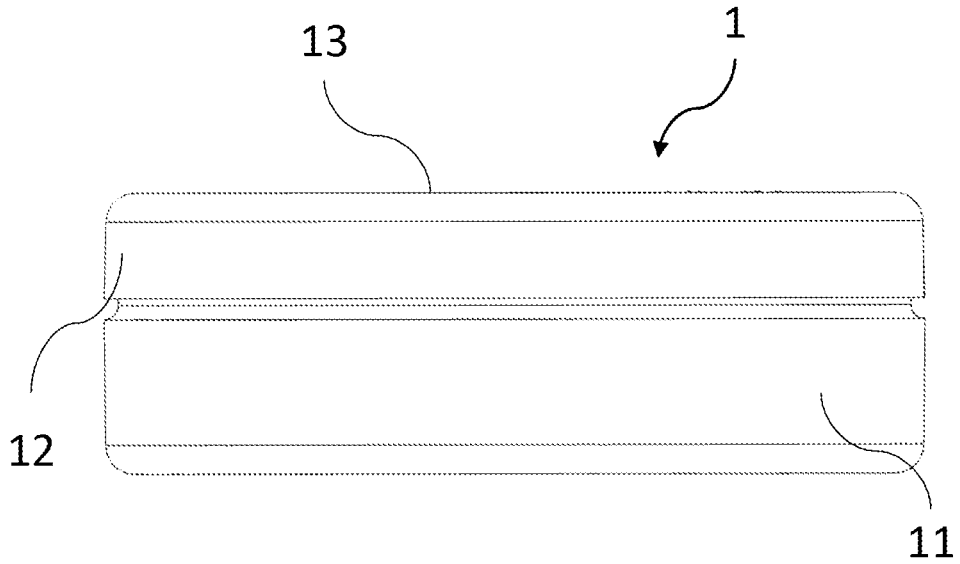
FIG. 2 shows a side view of the snus container according to one embodiment of the invention.

FIG. 2 shows a side view of the snus container 1 according to one embodiment of the invention, wherein both the first lid 12 and the second lid 13 are in their respective closed positions.

Figure 3:
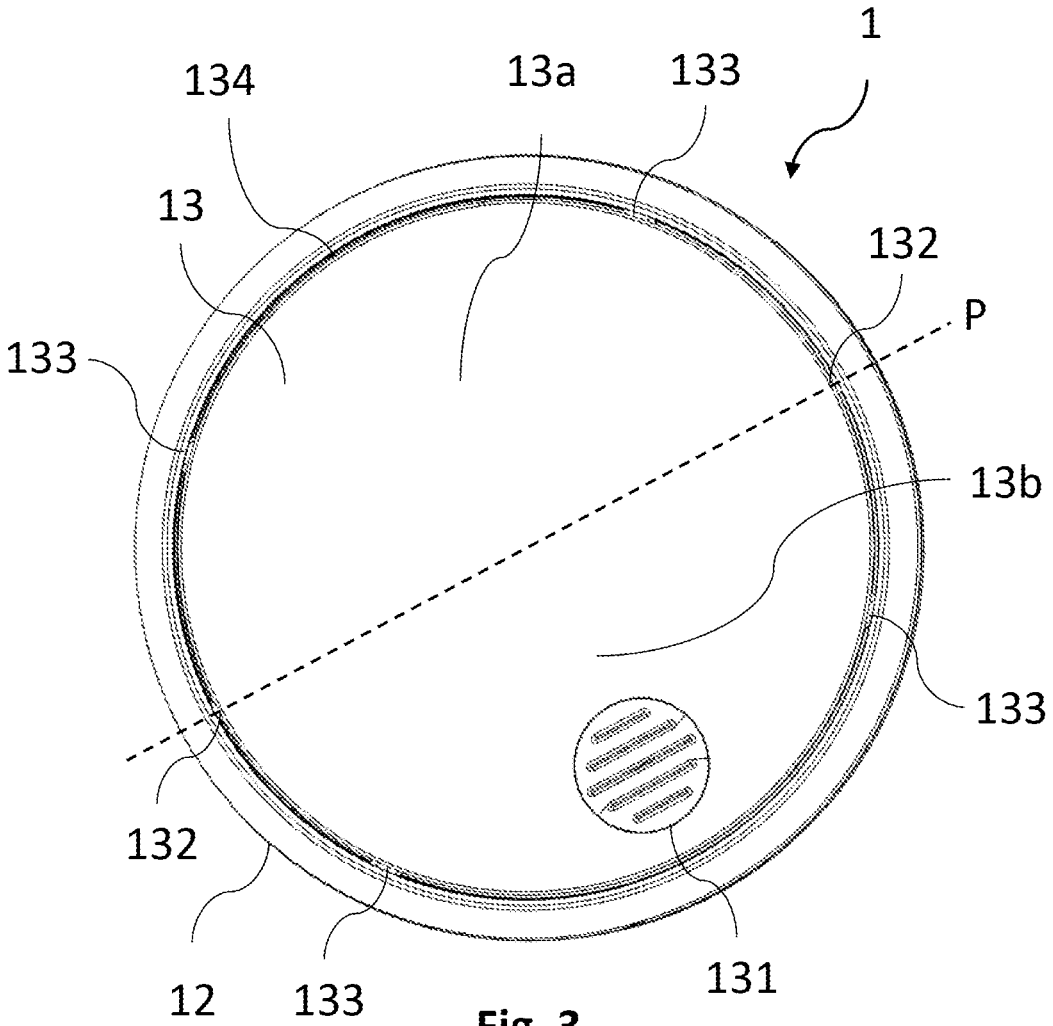
FIG. 3 shows a top view of the snus container according to one embodiment of the invention.

FIG. 3 shows a top view of the snus container 1 according to one embodiment of the invention. In this embodiment, the second lid 13 comprises a first portion 13*a* adapted to move away from the bottom of the second compartment 120 when the second lid 13 pivots to the semi-open position from the closed position. The second lid 13 also comprises a second portion 13*b* connected to the first portion 13*a* which provides the actuation region 131 so that when pushed toward the bottom of the second compartment 120, the second lid 13 is actuated to pivot from the closed position to the semi-open position. As can be seen in FIG. 3, the first portion 13*a* and the second portion 13*b* of the second lid 13 represent two respective halves of the second lid 13 divided along the pivot axis P.

The actuation region 131 is an actuation surface 131 recessed with the respect to the outward surface of the second lid 13. The actuation surface 131 is further recessed smoothly with a slight curvature. Moreover, the actuation surface 131 is provided with a differing texture with respect to the outward surface of the second lid 13. The actuation surface 131 is provided with a ribbed texture. By providing an actuation surface 131 with a particular structural difference with respect to the remainder of the outward facing surface of the second lid, it enables a user to quickly identify where the second lid 13 is intended to be pushed so as to pivot the second lid 13 to the semi-open position. In addition or alternatively, the actuation region 131 may comprise or be a sticker or a marking which enables a user to identify where the second lid 13 is intended to be pushed so as to pivot the second lid 13 to the semi-open position.

Moreover, the first portion 13*a* of the second lid 13 may be adapted in shape and size to provide a gripping region 134 that may be exposed for access when the second lid 13 is in the semi-open position. The gripping region 134 may facilitate the second lid 13 to be detached from the first lid 12 in order to fully open the second compartment 120. The gripping region 134 may comprise a gripping edge 134 and an adjacent recessed which together facilitates gripping of the second lid 13.

In one embodiment, the second lid 13 is adapted to be maintained in the closed position by means of at least one latching protrusion 133 adapted to latch with a respective latching recess 123 until a predetermined force acts on the actuation region 131 causing the second lid 13 to pivot away from the closed position toward the semi-open position. In FIG. 3, the snus container 1 comprises four latching protrusions 133 arranged symmetrically along a side surface of the second lid 13. The four latching protrusions 133 are each arranged to be able to latch with a respective latching recess 123 provided along inner side walls of the second compartment 120 defined by the first lid 12. The latching protrusions 133 are preferably adapted in shape and size with a curved geometry which facilitates the latching protrusions 133 to move in and out of the respective latching recesses 123 when said predetermined force acts on the actuation region 131.

Figure 4:
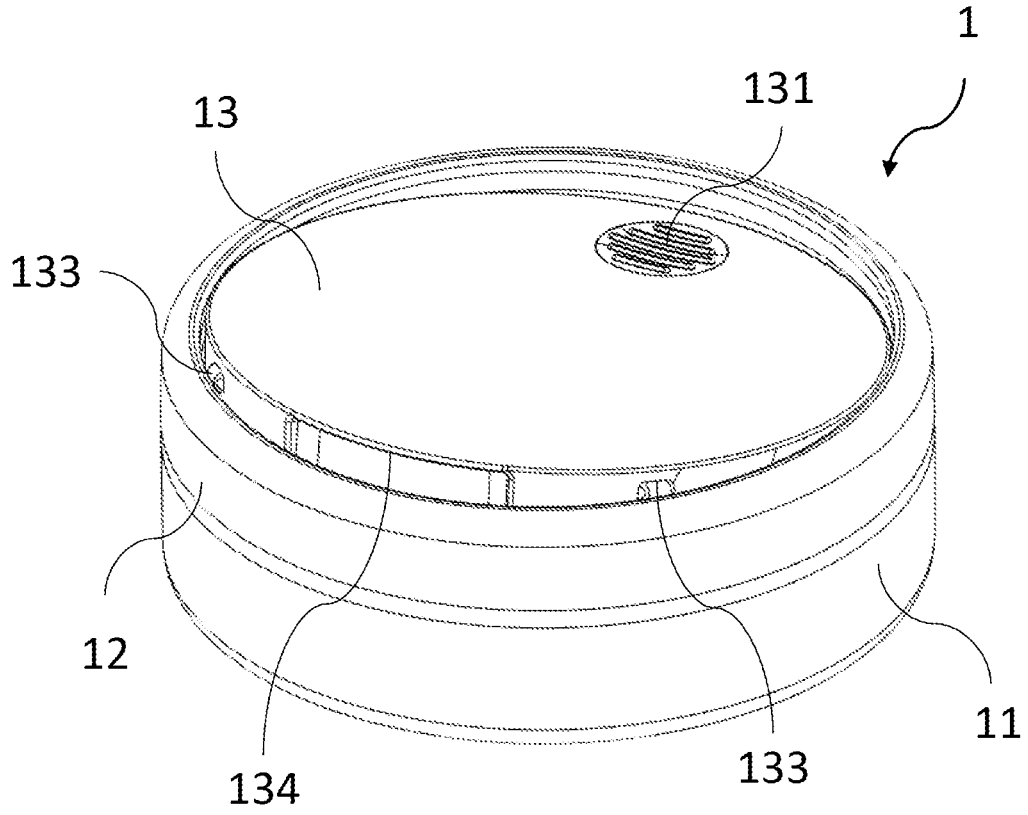
FIG. 4 shows a perspective view of the snus container according to one embodiment of the invention when the second lid is in a semi-open position.
Figure 5:
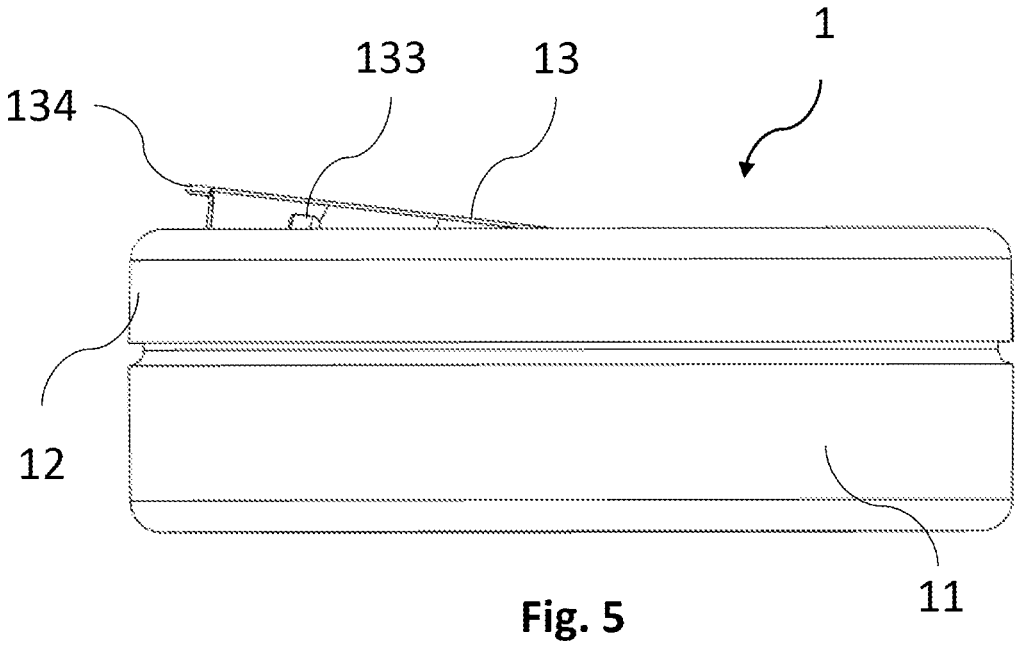
FIG. 5 shows a side view of the snus container according to one embodiment of the invention when the second lid is in a semi-open position.

FIGS. 4 and 5 show the snus container 1 when the second lid 13 is in a semi-open position. Two latching protrusions 133 are visible in view as well as the gripping region 134 here shown as a gripping edge and an adjacent recessed below said gripping edge.

Figure 6A:
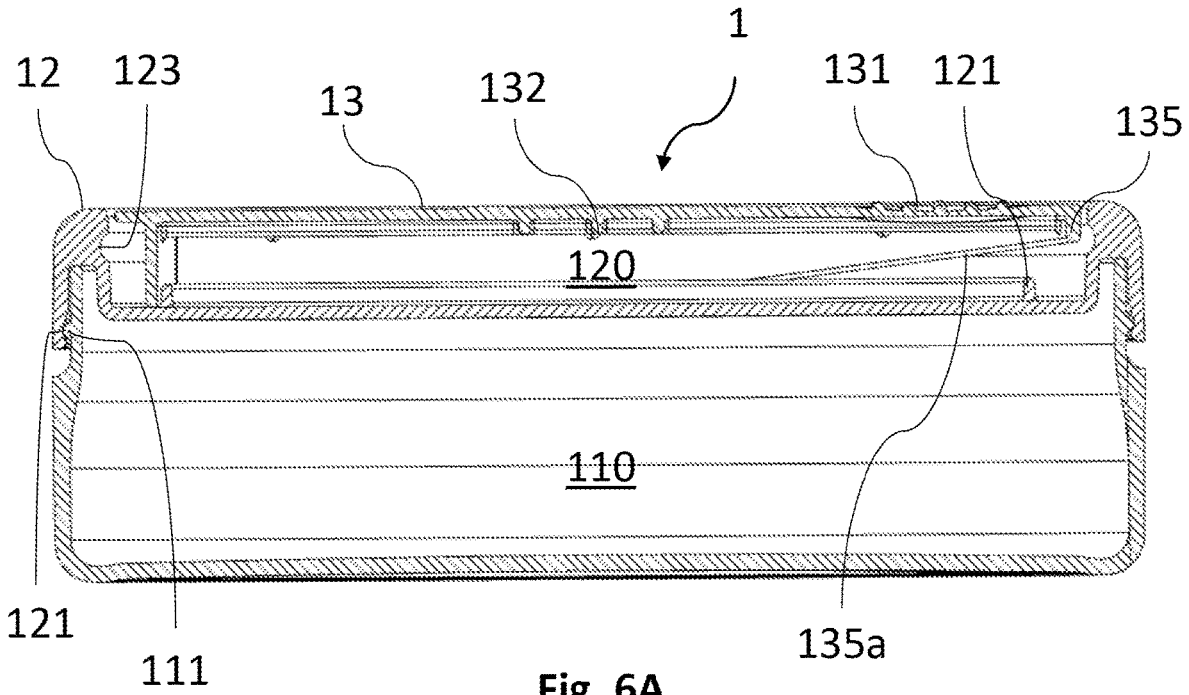
FIG. 6A shows a cross-sectional side view of the snus container according to one embodiment of the invention when the second lid is in a closed position.
Figure 6B:
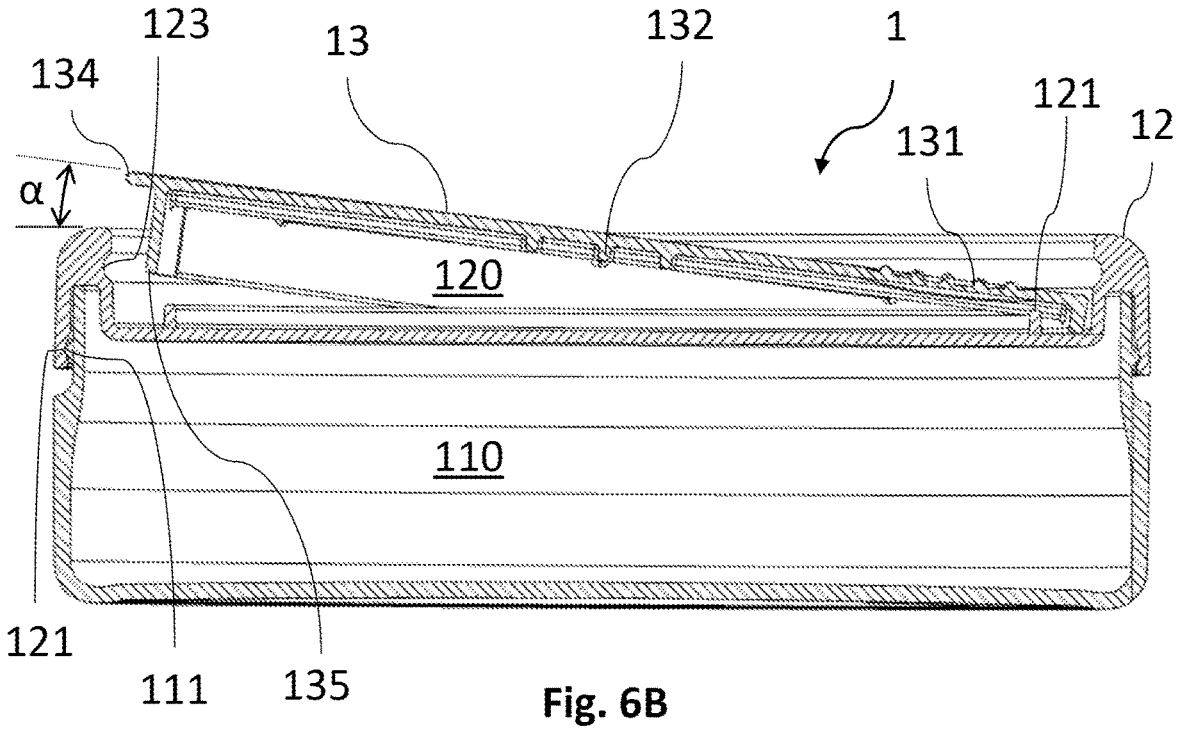
FIG. 6B shows a cross-sectional side view of the snus container according to one embodiment of the invention when the second lid is in a semi-open position.

FIGS. 6A and 6B show a cross-sectional side view of the snus container 1 according to one embodiment of the invention. Specifically, FIG. 6B shows the snus container 1 when the second lid 13 is in a closed position. Meanwhile, FIG. 6*b* show the snus container 1 when the second lid 13 is in a semi-open position. The snus container is adapted in shape and size so that the pivot angle $\alpha$ of the second lid 13 when pivoted between the closed position and the semi-open position is 5-20 degrees, preferably 5-15 degrees, and most preferably 6-10 degrees. Specifically, the pivot angle $\alpha$ of the second lid 13 shown in FIG. 6B is about 7 degrees.

Further, the snus container 1 may comprise an engaging portion 135*a* adapted in size and shape to engage with the bottom of the second compartment 120 when the second lid 13 is in the semi-open position. The engaging portion 135*a* extends out from the bottom of the second lid 13 such that the respective height varies along a circumferential direction. The height is smallest at a right angle to the pivot axis, i.e. in the vicinity of the actuation region 131, and continuously increases therefrom in either circumferential direction towards locations proximate the pivot axis P. The engaging portion 135 is a portion of an otherwise cylindrical inner side wall adapted to be received in the second compartment 120. The engaging portion 135 may define a first half of the cylindrical inner side wall, whereas the other half of the inner side wall has a constant height adapted in shape and size so that it prevents the second lid 13 to be pushed so that the half of the second lid 13 not providing the actuation region 131 is pushed into the second compartment 120.

The snus container 1 may also comprise a boundary element 121 extending up from the bottom of the second compartment 120 at a position proximate the actuation region 131 of the second lid 13. By this, snus portions may be prevented from being positioned in the second compartment 120 such that it limits the second lid's 13 ability to pivot about the pivot axis P. The boundary element 121 extends up from the bottom of the second compartment 120 at a position proximate the actuation region 131 to a point where it at most abuts the second lid when in a semi-open position. The boundary element 121 also forms a part of a cylindrical inner side wall extending up from the bottom of the second compartment 120 which defines a region where snus portions may reside. As shown in FIG. 6A, the inner side wall of the second lid 13 and the inner side wall extending up from the bottom of the second compartment 120 are mutually arranged to at least partly be adjacent each other when the second lid 13 is in a closed position. A further effect of the boundary element 121 is that it may act as a pivot element when detaching the second lid 13 from the first lid 12.

Figure 7:
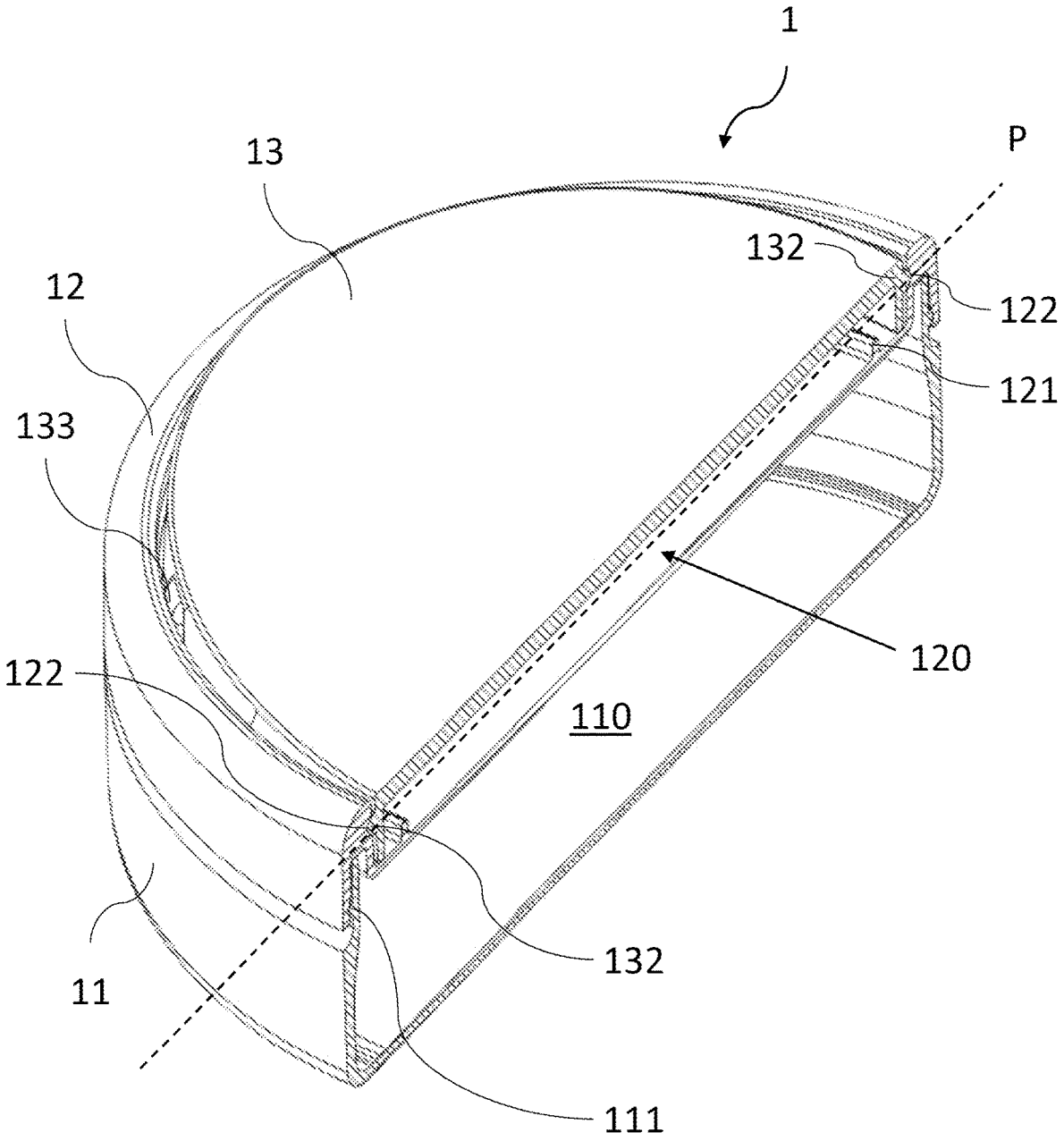
FIG. 7 shows a cross-sectional perspective view of the snus container according to one embodiment of the invention.

FIG. 7 shows a cross-sectional perspective view of the snus container 1 according to one embodiment of the invention. The snap-in coupling 122, 132 is provided by means of two pivot protrusions 132 mutually arranged to define the pivot axis and adapted to releasably couple to a respective pivot recess 122. The two pivot protrusions 132 have a substantially semi-spherical shape and extends out from a side surface of the second lid 13 facing inner side walls of the second compartment 120 defined by the first lid 12. The respective pivot recess 122 are correspondingly semi-spherical apertures arranged accordingly along said inner side walls of the second compartment 120 defined by the first lid 12. The first lid 12 is adapted to be able to flexibly receive the second lid 13 by said snap-in coupling 122, 132. This enables the second lid 13 to be conveniently attached and detached from the first lid 12 a number of times in a controllable manner.

Figure 8:
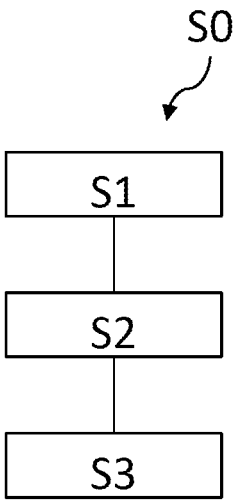
FIG. 8 shows a flow chart of a method of manufacturing a snus container according to one embodiment of the invention.

FIG. 8 shows a flow chart of a method S0 of manufacturing a snus container 1 according to one embodiment of the invention. The method S0 comprises the steps of providing S1 a mould 100 defining a plurality of mould cavities 1021, 1022, 1023 corresponding to the shapes of the body 11, the first lid 12, and the second lid 13 of the snus container 1; injecting S2 a material into the plurality of mould cavities 1021, 1022, 1023, and once solidified, ejecting S3 the snus container 1 from the mould 100. The snus container 1 may be formed as a single piece which is then later separated into the separate components body 11, first lid 12, second lid 13. The material used may be a plastic or a polymer material.

Figure 9:
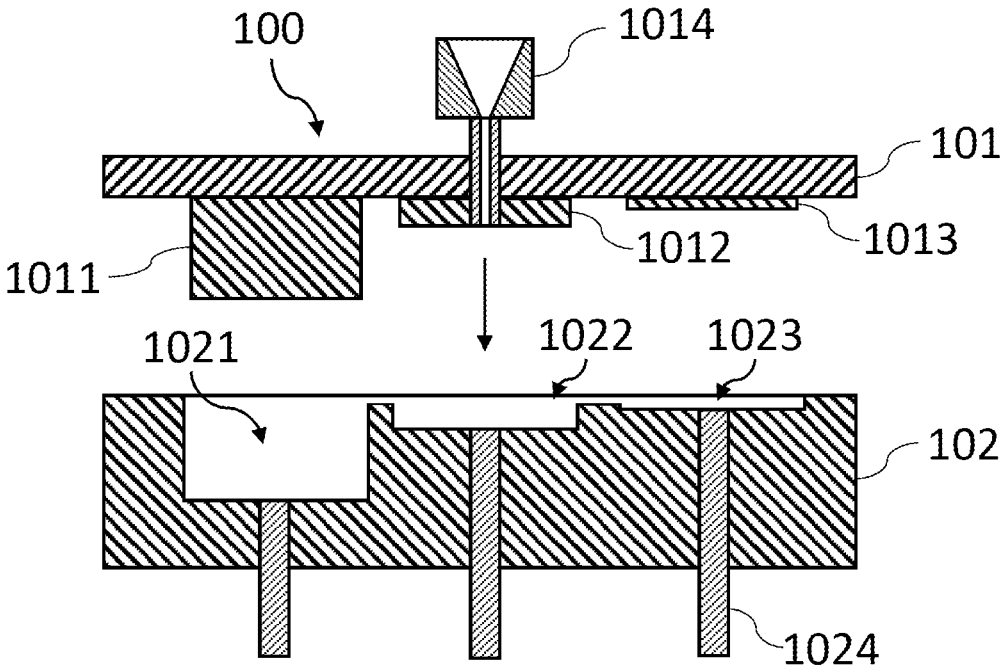
FIG. 9 shows a cross sectional side view of a mould used during the method of manufacturing a snus container according to one embodiment of the invention.

FIG. 9 shows a cross-sectional view of a mould 100 used during the method S0 of manufacturing a snus container 1 according to one embodiment of the invention. The mould 100 comprises an upper mould part 101 and a lower mould part 102. The lower mould part 102 is adapted in shape and size to define a plurality of recesses 1021, 1022, 1923 adapted to receive protrusions 1011, 1012, 1013 respectively of the upper mould part 101 when the upper mould part 101 and the lower mould part 102 are pressed together. The recesses and protrusions together define moud cavities corresponding to the body 11, first lid 12, and second lid 13 of the snus container. A nozzle 1014 guides material into the mould cavities. Once the snus container 1 has solidified, the snus container 1 is ejected by ejection pins 1024. Preferably, the material used is a plastic or polymer material.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A snus container, comprising:

a body defining a first compartment;

a first lid adapted to be releasably attached to the body so that it closes the first compartment, the first lid defining a second compartment separated from the first compartment, wherein one of said first and second compartment is adapted for storing unused snus portions while the other of said first and second compartment is adapted for storing used snus portions, and a second lid pivotably coupled to the first lid to be able to, upon pressing an actuation region of the second lid, to pivot about a pivot axis (P) from a closed position, in which the second lid closes the second compartment, to a semi-open position at which position access to the second compartment is still prevented, wherein the second lid is pivotably coupled to the first lid by means of a snap-in coupling enabling the second lid to reversibly detach from the first lid when the second lid is in the semi-open position, wherein the second lid comprises:

a first portion adapted to move away from the bottom of the second compartment when the second lid pivots to the semi-open position, thereby exposing a gripping region of the second lid, and a second portion connected to the first portion and providing the actuation region so that when pushed toward the bottom of the second compartment, the second lid is actuated to pivot from the closed position to the semi-open position, and wherein access to the second compartment is enabled by removing the second lid from the first lid.

2. The snus container according to claim 1, wherein the second lid is adapted to be maintained in the closed position by means of at least one latching protrusion adapted to latch with a respective latching recess until a predetermined force acts on the actuation region causing the second lid to pivot away from the closed position toward the semi-open position.

3. The snus container according to claim 2, wherein the second lid comprises at least two latching protrusions wherein each of the first portion and the second portion of the second lid comprises at least one respective latching protrusion of said at least two latching protrusion.

4. The snus container according to claim 2, wherein the second lid comprises four latching protrusions.

5. The snus container according to claim 1, wherein the snap-in coupling is provided by means of two pivot protrusions mutually arranged to define the pivot axis (P) and adapted to releasably couple to a respective pivot recess to enable the second lid to pivot about the pivot axis (P).

6. The snus container according to claim 5, wherein the two pivot protrusions have substantially semi-spherical shapes and the snap-in coupling is further provided by means of two pivot recesses having correspondingly semi-spherical apertures.

7. The snus container according to claim 1, wherein the second lid comprises an engaging portion adapted in size and shape to engage with the bottom of the second compartment when the second lid is in the semi-open position.

8. The snus container according to claim 1, wherein the first lid comprises a boundary element extending up from the bottom of the second compartment at a position proximate the actuation region.

9. The snus container according to claim 1, wherein the snus container is adapted in shape and size so that the pivot angle (a) of the second lid when pivoted between the closed position and the semi-open position is from about 5 to about 20 degrees.

10. The snus container according to claim 9, wherein the pivot angle ($\alpha$) is from about 5 to about 15 degrees.

11. The snus container according to claim 9, wherein the pivot angle ($\alpha$) is from about 6 to about 10 degrees.

12. A method of manufacturing the snus container according to claim 1, comprising the steps of:

providing (S1) a mould (100) defining a plurality of mould cavities corresponding to the shapes of the body, the first lid, and the second lid of the snus container;

injecting (S2) a material into the plurality of mould cavities, and once solidified, ejecting (S3) the snus container from the mould.

13. A mould is adapted in shape and size to define a plurality of cavities corresponding to the shapes of the body, first lid and second lid of the snus container according to claim 1.

14. A snus container, comprising:

a body defining a first compartment;

a first lid adapted to be releasably attached to the body so that it closes the first compartment, the first lid defining a second compartment separated from the first compartment, wherein one of said first and second compartment is adapted for storing unused snus portions while the other of said first and second compartment is adapted for storing used snus portions, and a second lid pivotably coupled to the first lid to be able to, upon pressing an actuation region of the second lid, to pivot about a pivot axis (P) from a closed position, in which the second lid closes the second compartment, to a semi-open position at which position access to the second compartment is still prevented, wherein the second lid is pivotably coupled to the first lid by means of a snap-in coupling enabling the second lid to reversibly detach from the first lid when the second lid is in the semi-open position, wherein the second lid comprises:

a first portion adapted to move away from the bottom of the second compartment when the second lid pivots to the semi-open position, thereby exposing a gripping region of the second lid, and a second portion connected to the first portion and providing the actuation region so that when pushed toward the bottom of the second compartment, the second lid is actuated to pivot from the closed position to the semi-open position, wherein access to the second compartment is enabled by removing the second lid from the first lid, and wherein the second lid comprises an engaging portion adapted in size and shape to engage with the bottom of the second compartment when the second lid is in the semi-open position, and the engaging portion extends at least partly in a circumferential direction of the second lid and has a minimum height at a position perpendicular from the pivot axis (P) along said circumferential direction and the height of the engaging portion increases along each of the two circumferential directions towards points proximate the pivot axis (P) from said position of minimum height of the engaging portion.

* * * * *